United States Patent [19]

Hartman

[11] 4,007,575

[45] Feb. 15, 1977

[54] SEMI-AUTOMATIC PACKING OF PACKAGES

[76] Inventor: Carl C. Hartman, 415 N. Pacific COH, Mineola, Tex. 75773

[22] Filed: Mar. 5, 1975

[21] Appl. No.: 555,567

Related U.S. Application Data

[62] Division of Ser. No. 454,449, March 25, 1974, Pat. No. 3,890,764, which is a division of Ser. No. 267,022, June 28, 1972, Pat. No. 3,815,321.

[52] U.S. Cl. ..... 53/26; 53/61; 53/35; 53/159; 53/162

[51] Int. Cl.[2] ..... B65B 35/40

[58] Field of Search ..... 53/26, 159, 61, 35, 53/162

[56] References Cited

UNITED STATES PATENTS

| | | | |
|---|---|---|---|
| 2,857,721 | 10/1958 | Ardell et al. | 53/26 |
| 3,604,181 | 9/1971 | Adcox | 53/61 |
| 3,698,153 | 10/1972 | Lieberman | 53/61 |

*Primary Examiner*—Donald R. Schran
*Attorney, Agent, or Firm*—James C. Fails

[57] ABSTRACT

Method and apparatus for semi-automatically packing packages being supplied by automatic packaging apparatus at a rapid rate, characterized by the steps of or means for diverting the packages sequentially into one or more chutes; accumulating the packages from all chutes on a gate; transferring the packages from the gate and in a desired position into a receiver; providing clearance in the receiver for a next package or packages transferred from the gate; repeating the above steps until a predetermined number of packages have been accumulated in the receiver and thereafter removing the predetermined number of packages to make room for the next predetermined number of packages. Specifically disclosed inventive features that are worthy of note in the invention include one or more inclined and pivotally mounted load chutes; a ram with slots; and a comb with fingers that interact with the slots to hold the bags at an advanced position as the ram is retracted to receive the next plurality of packages from the gate, and a couple of forms of surge means enabling a single operator using the apparatus to readily handle the rapidly incoming packages.

2 Claims, 12 Drawing Figures

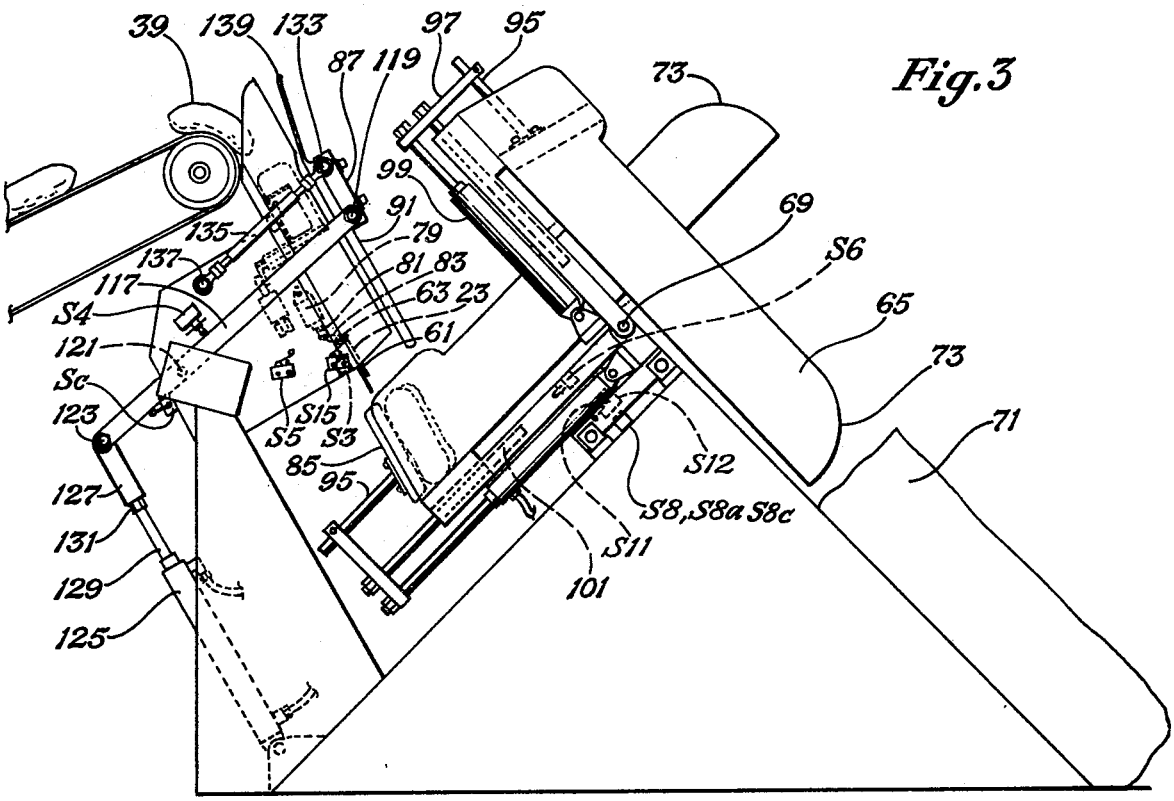
Fig.3
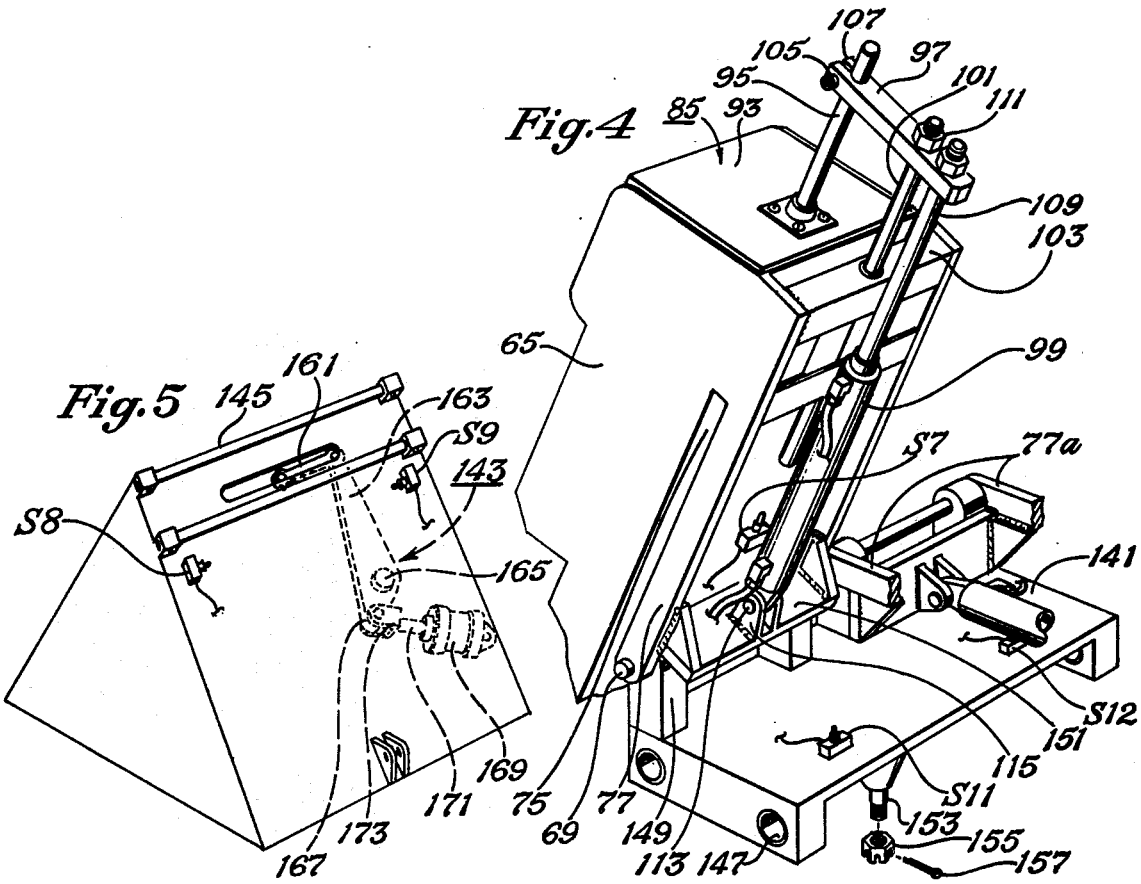
Fig.4
Fig.5

SEMI-AUTOMATIC PACKING OF PACKAGES

CROSS REFERENCES TO RELATED APPLICATIONS

This is a division of application Ser. No. 454,449, filed Mar. 25, 1974 now U.S. Pat. No. 3,890,764 which was a division application of Ser. No. 267,022, filed June 28, 1972 now U.S. Pat. No. 3,815,321.

BACKGROUND OF THE INVENTION

1. Field of the Invention:

This invention relates to semi-automatic packing apparatus, sometimes referred to as baling machines when flexible walled containers are employed. More particularly, this invention relates to method and apparatus for at least semi-automatically packing packages being supplied at a rapid rate by automatic packaging apparatus.

2. Description of the Prior Art:

A wide variety of packaging and packing apparata have been tried in the prior art. Heretofore, the packing apparatus has been either overly sophisticated or relatively crude and slow; the latter being, nonetheless, sufficient to do its job with old packaging apparatus. With the advent of a new generation of improved automatic packaging machines; such as, those supplied by Triangle Machinery Corporation, Chicago, Illinois; the packages were formed so rapidly that conventional packing apparatus would not suffice. To illustrate, automatic packaging apparatus supplied by Triangle Machinery Corporation and employed for packaging dried material such as beans and rice, will package one bag each second. This has required a plurality of workmen to pack the bags supplied at this rapid rate, employing conventional packing apparatus.

On the other hand very sophisticated, expensive and elaborate packing apparatus has been designed to handle the output of four modern packaging machines. Aside from its expense, the sophisticated packing apparatus required all four machines to be packing the same product and same size packages—such standardization of packaging not ordinarily being employed.

The semi-automatic packing apparatus should have one or more, and preferably all of, the following desirable features, although they have not been provided heretofore. The apparatus should be matched to a single packaging machine for desired flexibility and economy and should have: (1) means for moving the packages in a receiver to provide room to receive the next plurality of packages and a means for holding the packages at the new position; (2) a means for retaining the packages in the position in which they are emplaced into a receiver; (3) in specific embodiments, a ram and a chute for receiving the packages and advancing the plurality of packages to afford clearance for the next plurality, in combination with a comb to hold the packages where they have been advanced; the comb and the ram having interacting means; (4) the feature (3) wherein the chute is inclined at an angle sufficient to hold the packages in the position in which they are received in the chute; (5) a surge means to enable an operator to readily handle the incoming packages being received at the rapid rate; and (6) pivotal load chute such that the predetermined number of packages can be emplaced in the load chute, a container emplaced about the open end of the load chute and the loaded chute pivoted with minimal effort by the operator to emplace the predetermined number of packages into the container.

Insofar as I am aware, however, the prior art has not supplied method or apparatus for semi-automatically packing packages being supplied at a rapid rate by currently available automatic packaging machines; matching each packing apparatus to a packaging machine for utmost flexibility and ecomony without requiring either standardization in operation of a plurality of packaging machines or a plurality of workmen to do the packing of each modern packaging machine. Particularly, the prior art has not provided packing apparatus having the desirable features delineated hereinbefore.

Accordingly, it is an object of this invention to provide semi-automatic packing method and apparatus that can be matched to modern automatic packaging machines and to afford desired flexibility and economy and enable packing packages being supplied therefrom at a rapid rate; yet, require only a single operator to handle the output of a given automatic packaging machine.

It is also an object of this invention to provide semi-automatic packing apparatus having one or more of the desirable features delineated hereinbefore and not heretofore provided by the prior art apparatus.

It is also an object of this invention to provide specific embodiments which have all of the desireable features delineated hereinbefore.

These and further objects of this invention will become apparent from the descriptive matter hereinafter, particularly when taken in conjunction with the drawings.

BRIEF DESCRIPTION OF THE DRAWINGS:

FIG. 3 is a side elevational view of the embodiment of FIG. 1 with the comb raised and a load chute pivoted into the "dump" position.

FIG. 4 is a partial isometric view of the carriage of the embodiment of FIGS. 1–3.

FIG. 5 is a bottom isometric view of the shift means for shifting the carriage of FIG. 4.

DESCRIPTION OF THE PREFERRED EMBODIMENTS

Figure 1:
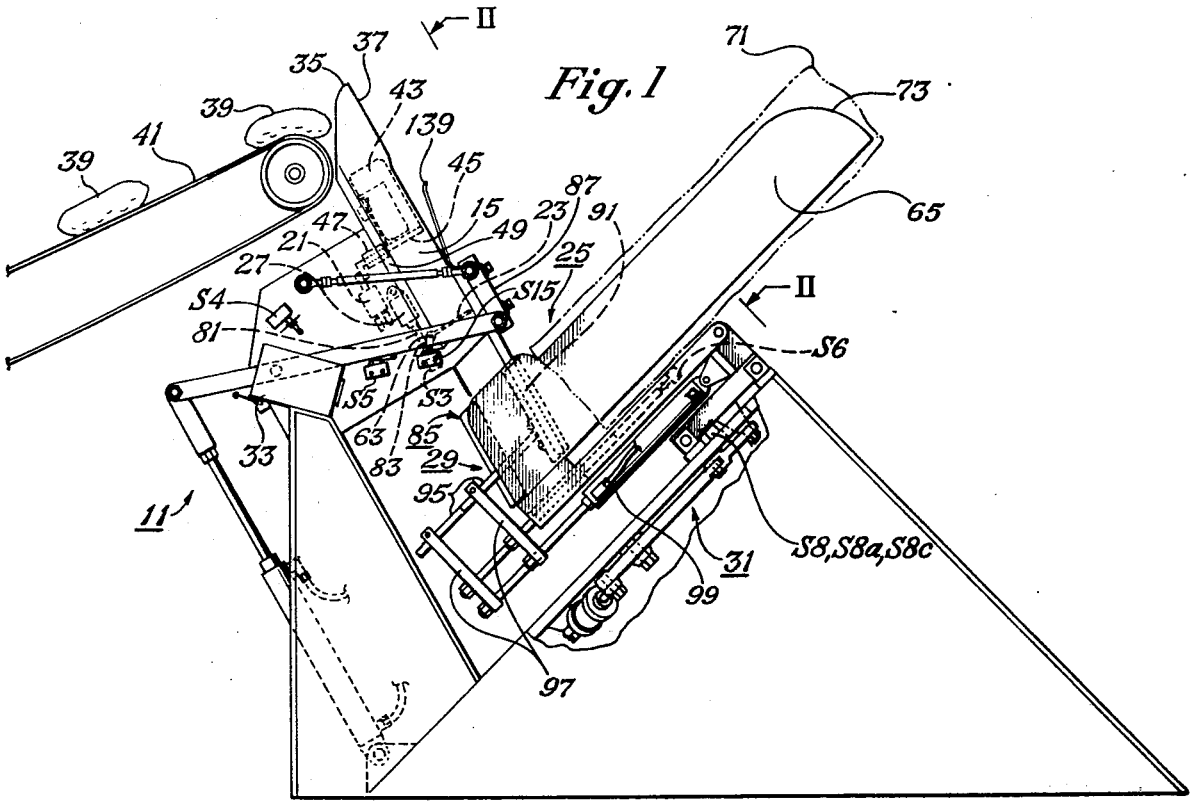
FIG. 1 is a side elevational view of a baling machine with its comb down for retaining packages in position, in accordance with one embodiment of this invention.

The following broad outline of steps followed in a method of operation affords insight into the interrelationships between some of the explicitly recited broad aspects of the invention and specific embodiments and is helpful in understanding the specific embodiments described hereinafter. In considering these steps, it should be borne in mind that automatic packaging apparatus packages materials into packages. The materials may be, for example, dried beans, rice and the like. The packages may comprise any container; such as, boxes and, in modern packaging, flexible walled bags. The modern apparatus feeds the filled bags via a conveyor belt at the rate of one per second to the semi-automatic packing apparatus. Consequently, the semi-automatic packing apparatus must be able to assimilate the bags supplied at the rate of one per second and enable an operator to emplace repeatedly a predetermined number of the packages, or bags, into a container without overworking. The following method steps are employed to do so.

Insert (1)

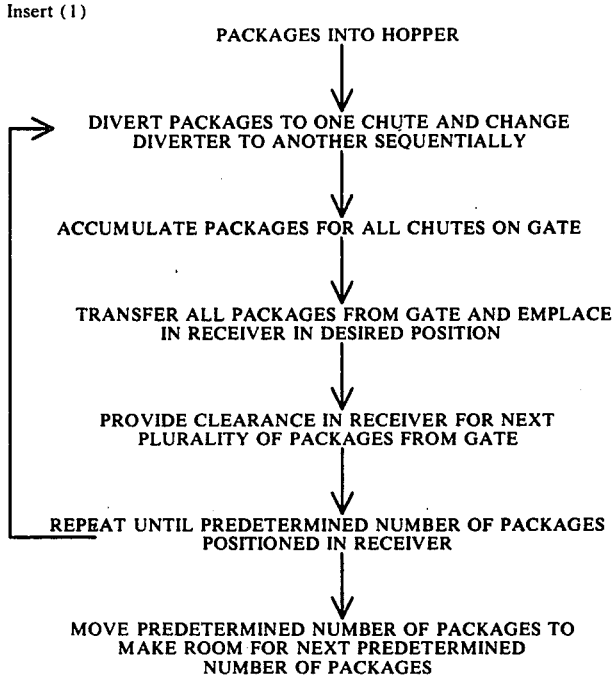

To perform the method, semi-automatic apparatus is employed as follows:

Insert (2)

-continued

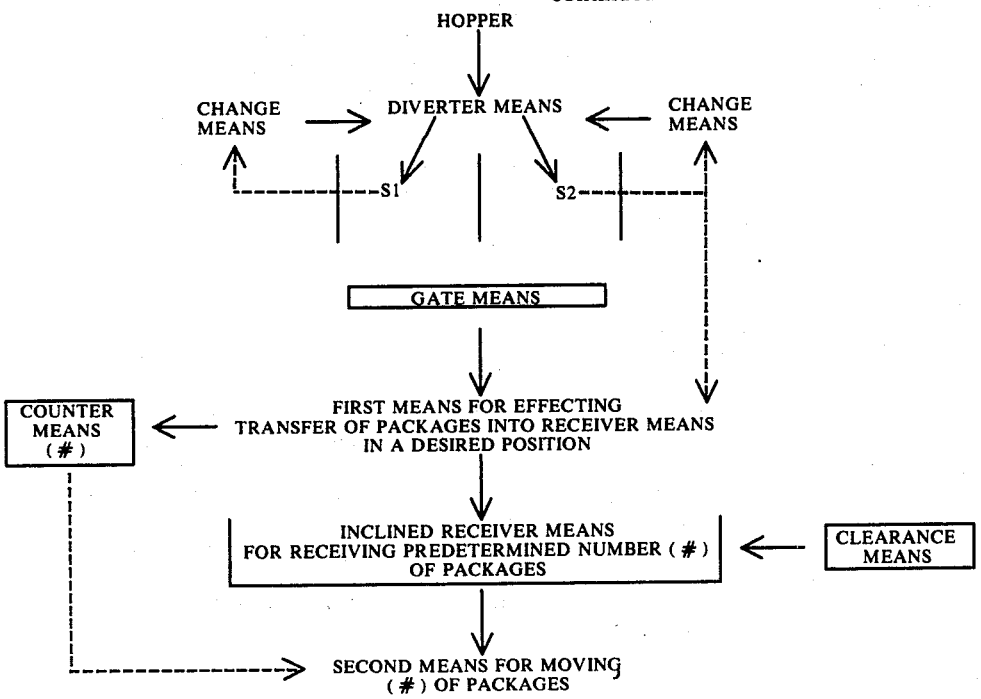

The foregoing shows that the invention comprises method steps of and apparatus for (a) diverting the packages as they are fed into the hopper sequentially into one of a plurality of respective chutes; (b) accumulating the packages from all of the chutes on a gate; (c) transferring the packages from the gate and in a desired position into a receiver; (d) providing clearance in the receiver for a next plurality of packages transferred from the gate; (e) repeating steps (a)–(d) until a predetermined number of packages have been accumulated in the receiver and, thereafter, (f) removing the predetermined number of packages to make room for a next predetermined number of packages. The receiver is positioned; for example, at an inclined angle; so as to retain the packages, or bags, in the desired position in which they are emplaced thereinto. To afford the desired flexibility of packing the output of any modern packaging machine, however, the method and apparatus must accomodate aligned single packages; such as, a bale of 6 bags, each having 4 pounds of product. Such packaging only requires one chute. It is more difficult to operate with a plurality of chutes and high speed incoming packages. Consequently, these are the specific embodiments described hereinafter. As is recognized in the art, the handling and packing of flexible walled bags presents a severe problem that has heretofore required elaborate solutions, such as vacuum cups on fingers. It is in this difficult area of packing bags that this invention achieves its greatest usefulness and demonstrates its inherent advantages.

One embodiment of this invention is illustrated in FIGS. 1–8. Therein, the apparatus 11 is a semi-automatic packing apparatus that comprises a structural embodiment of the broad apparatus delineated hereinbefore. Specifically, the apparatus 11 includes a plurality of upstanding chutes 15 and 17; and diverter means 19 for diverting the incoming packages sequentially into respective ones of the plurality of chutes; first change means 21 for changing the diverter means into its next sequential position; a plurality of respective switch means such as switches S1 and S2 for effecting switching of the diverter means 19 responsive to passage of a bag downwardly through the chute that the particular switch is monitoring. The apparatus 11 also has gate means 23 for accumulating the packages from the plurality of chutes; receiver means 25 for receiving the plurality of packages from the gate means 23; first means 27 for effecting movement of the packages from the gate means 23 into the receiver means 25 in a desired position; clearance means 29 for effecting a clearance space in the receiver means 25 sufficient to receive the next plurality of packages from the gate means 23 until a predetermined number of packages are emplaced in the receiver means; and a second means 31 for moving the predetermined number of packages from beneath the gate means 23 to make room for the next plurality of packages. A counter means 33 is employed for counting each time a plurality of packages is transferred from the gate means into the receiver means and for signalling when a predetermined number of bags have been emplaced in the receiver means so that the second means can move the predetermined number of packages from beneath the gate means 23.

As illustrated, the apparatus 11 includes a hopper 35 having a front deflector plate 37. The front deflector plate 37 was installed in the event that packages 39 were sent over the top too rapidly by conveyor belt 41 such that the inertia would overshoot the packing apparatus 11. The front deflector plate 37 was found to be unnecessary. The hopper 35 contains, as indicated, a pair of chutes 15 and 17. Any plurality of chutes may be employed, as desired. I have found two chutes adequate to enable a single operator using the semi-automatic packing apparatus 11 to handle the indicated output for automatic packaging machines. The chutes 15 and 17 may be ill defined passageways, or they may be completely defined with surrounding sidewalls. I have found it helpful to employ a dividing partition to help retain the flexible walled bags 39 in the desired upright position while they are emplaced on the gate means 23. The chutes are upstanding to a sufficient degree that gravity will effect movement of the bags longitudinally thereof, and handling, per se, will not be required.

The diverter means 19 comprises flap 43 that is moved into the right hand or left hand position for diverting a package respectively and sequentially to one of the plurality of chutes 15 and 17. The diverter means 19 may comprise any appropriate structure that will effect the described results, but a flap is particularly advantageous where only two chutes are employed. As illustrated, the flap 43 is mounted on shaft 45 for pivotal movement. The shaft 45 is journalled in suitable bearing 47 that is carried by the main frame 49.

The first change means 21 for changing the shaft 45 and flap 43 into its next sequential position comprises a two position motor means 51, shaft 53 and linkage 55. As illustrated, the motor means 51 is a two-position Bellows air motor that has a limit switch mounted on its end such that, once pulsed, the motor will move to its other position. This movement to its other position is translated via its shaft 53 and linkage 55 into movement of the flap 43 into its other position.

The plurality of respective switch means comprises switches S1 and S2 and respective trigger means, such as arms 57 and 59. The arms 57 and 59 are disposed in the respective chutes to monitor the chutes such that a bag passing will effect closure of the respective switch S1 or S2. Closure of the respective switches S1 and S2 will effect a change of the flap 43 to its other position. Thus, it can be seen that the closure of the respective switches will effect automatic and sequential changing of the flap 43 and automatic and sequential diverting of the bags 39 into respective chutes on top of the gate means 23.

The gate means 23 comprises a gate 61 that is disposed transversely across the bottom of the respective chutes 15 and 17 and substantially perpendicular to the back of the chutes and the main frame 49 so as to collect the downcoming bags 39 in all the chutes. If desired, the gate 61 may be mounted for reciprocal movement such that it can be withdrawn rearwardly from beneath the bags 39, allowing them to fall into the receiver. As illustrated, however, the gate 61 is pivotally mounted via shaft 63 such that it may be pivoted downwardly, as illustrated in FIG. 3, for allowing the bags 39 to fall into the receiver means 25.

Figure 2:
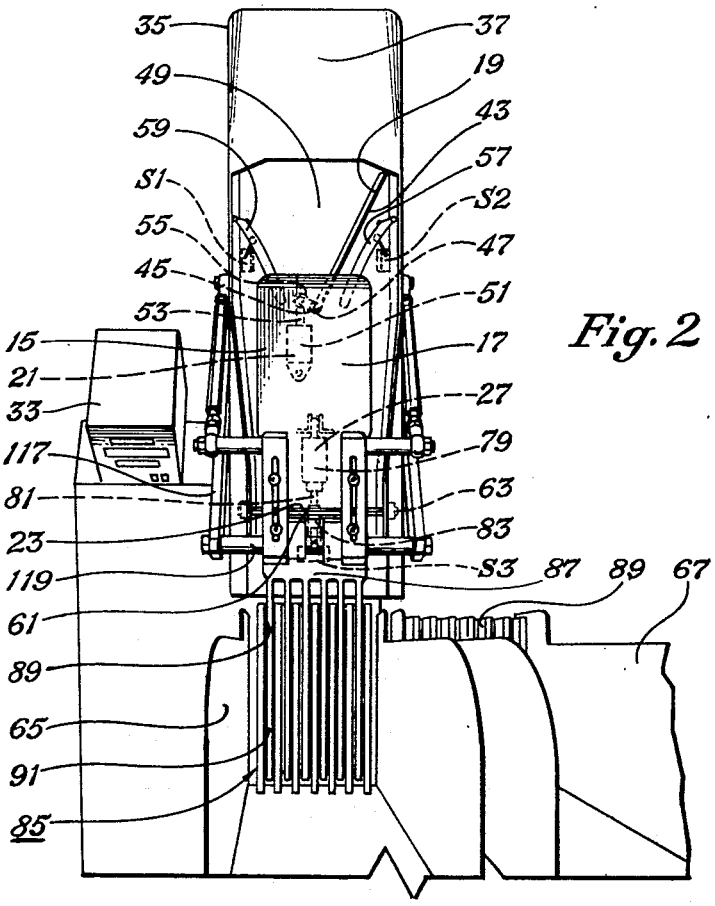
FIG. 2 is an oblique perspective view of the embodiment of FIG. 1.

The receiver means 25 may take a wide variety of forms, as will be seen from consideration of other embodiments described hereinafter. Preferably, the receiver means 25 is positioned beneath the gate means 23 such that the packages that are retained on the gate 61 in a desired position may slide downwardly into the receiver means in the desired position and the receiver means will be positioned such that the bags will retain the same position. Ordinarily, the receiver means may be inclined at an angle to enable the bags to be retained in the desired position. As illustrated in FIGS. 1 and 2, the receiver means 25 comprises a plurality of load chutes 65 and 67. Each load chute 65 and 67 is inclined at an angle sufficient to hold the bags in the desired upright position as the bags are moved up the chute. Preferably, the load chutes are inclined at an angle with respect to the horizontal of at least 30°. As illustrated, the load chutes 65 and 67 are inclined at an angle of about 45°.

As illustrated in FIG. 3, each load chute, such as load chute 65, is pivotally mounted to facilitate "dumping" a predetermined number of packages into a container 71. Expressed otherwise, each load chute is pivotally mounted for pivotal movement about a shaft, such as shaft 69, and has its open end unobstructed such that an open ended container 71, FIGS. 1 and 3, can be emplaced about the open end 73 of the load chute and the load chute 65 pivoted to emplace the predetermined number of packages in the container 71. As illustrated, substantially the full length of the chute 65 is unobstructed, as by slot 75, FIG. 4, such that the container 71 may be slid over, or emplaced about, substantially the full length of the chute 65. The slot 75 is defined by structurally strong members 77 whose outer ends encompass shaft 69 for the pivotal movement of the chute 65. A member 77 is provided on each side of the chute 65, as illustrated by the two members 77a shown in a broken away view on the right hand side of FIG. 4. This dual arrangement of the members 77 provides greater structural strength and better balance, and facilitates pivoting of the load chute to dump the predetermined number of bags 39 into the container 71. Each load chute 65 may be made of any material which has the requisite structural strength, yet which has a relatively low coefficient of friction so that the individual bags may be slid longitudinally thereof.

The first means 27 for effecting movement of the plurality of packages from the gate means 23 into the receiver means 25 comprises gravity and a third means for opening the gate 61 to allow the accumulated plurality of packages to fall into the respective load chute. The third means actually includes an "open" means for opening the gate 61 and a "close" means for closing the gate 61 and comprises motor means 79, its shaft 81 and linkage 83. As illustrated, the motor means 79, similarly as described with respect to motor means 51 hereinbefore, comprises a Bellows air motor and accoutrements, the motor being movable between one of two positions once triggered. Accordingly, the gate 61 is either closed, as illustrated in FIGS. 1 and 2 or open, as illustrated in FIG. 3.

The clearance means 29 will take any of a variety of forms appropriate to the type of receiver means employed. As illustrated, clearance means 29 comprises an active ram 85 for pushing the plurality of packages longitudinally of the load chute 65 and a comb 87 for holding the packages at the position to which they are advanced by the ram. The active ram 85 has a plurality of slots 89 open at the forward end. The comb 87 has a plurality of teeth 91 that move into the slots 89 for holding the bags 39 at the position to which they have been moved by the ram when it is advanced forwardly. The open ended slots allow the ram to be retracted after the comb has had its teeth emplaced. Thus, the ram can be retracted to receive the next plurality of packages with the teeth 91 of the comb 87 holding the packages in place in the load chute 65. The comb 87 with its teeth 91 has an "up" means and a "down" means such that it can be raised as the next plurality of packages are moved forwardly to allow them to pass under it; and then moved downwardly to engage teeth 91 with the slots 89 to hold all of the packages at the position to which they have been advanced. As illustrated most clearly in FIG. 4, the ram 85 comprises a piston 93 carried on rod member 95 and reciprocally movable by way of linkage 97, responsive to movement of fluid powered piston and cylinder arrangement 99. To ensure alignment and freely moving advancing and retracting of the ram 85, a guide rod 101 slides longitudinally of cross structural framework 103 connected to the member 77 of the load chute 65. As can be seen, the linkage 97 may be adjusted longitudinally of the rod member 95 by way of set screw 105 frictionally pulling together the jaws 107 disposed about rod member 95 for adjusting the positions of the ram 85. The linkage 97 is connected with the guide rod 101 and the piston rod 109 of the piston and cylinder arrangement 99 by way of apertures and nuts 111 disposed about the threaded ends thereof. The piston and cylinder arrangement 99 may be powered by any suitable fluid, such as hydraulic fluid; but I have found it preferably to employ pneumatically operated cylinders and air motors throughout to simplify the apparatus 11. The respective venting and directions of flow will be employed in accordance with conventional practice and the respective switching will be described in more detail hereinafter. It is sufficient to note that each ram has an "advance" means and a "retract" means. The advance means comprises piston and cylinder arrangement 99 and a pulse unit (PU FIG. 6) that, once pulsed, effects forward movement, or advancing, of the ram 85 by retraction of the piston rod 109 inwardly by supplying fluid under pressure to the piston rod side of the piston in the cylinder of the piston and cylinder arrangement 99. The retract means comprises piston and cylinder arrangement 99 and a pulse unit that, once pulsed, effects retraction of the ram 85 by supplying fluid under pressure to the cylinder side of the piston in the cylinder and piston arrangement 99. Thus, the piston and cylinder arrangement 99 with the respective pulse unit and third valving for directing the high pressure fluid to either the piston rod end of the piston or the cylinder end of the piston serve as advance means for advancing the ram 85 and as retract means for retracting it. If desired, a single bistable pulse unit may be employed for the respective pulse units effecting opposing actions as described herein. The cylinder end is anchored by way of shaft 113 in mounting brackets 115, carried by anchoring end 151.

The up means for raising the comb 87 comprises the piston and cylinder arrangement 125 and a pulse unit that, once pulsed, effects retraction of the piston rod. The down means for lowering the comb 87 comprises the piston and cylinder arrangement 125 and a pulse unit that, once pulsed, effects extension of the piston rod. Thus, the piston and cylinder arrangement 125, in combination with its respective pulse unit and fluid valving for supplying power to either the piston rod end of the piston or the cylinder end of the piston serve as up means for raising the comb 87 and as down means for lowering it. The comb 87 with its teeth 91 is carried in a pseudo parallelogram linkage for movement between its up and down positions. Specifically, the comb 87 is mounted on member 117 by shaft 119. The member 117 is mounted for pivotal movement about fulcrum shaft 121 and has its rearward end 123 connected with a fluid powered piston and cylinder arrangement 125. As illustrated, the rearward end 123 is connected to a flat piece 127 that is connected with the piston rod 129 by way of nut 131, FIG. 3. The top portion of the comb 87 is connected via shaft 133 with adjustable linkage 135 and positioning shaft 137. The adjustable linkage 135 may comprise, for example, a turnbuckle sort of centerpiece that has threads at each end for obtaining the correct angularity of the teeth 91 of the comb 87. Thus, as can be seen by examining FIGS. 1 and 3, the comb 87 maintains very nearly its same relative angularity in either the up or down position. As illustrated, the comb 87 has a deflector 139 for ensuring that the bags 39 pass downwardly through the respective chutes 15 or 17.

The counter means 33 comprises a conventional setback counter that is activated each time a plurality of packages are transferred from the gate means 23 into the receiver means. Thus, the counter means signals when a predetermined number of subcycles of transferring a plurality of packages from the gate means 23 into the receiver means have been effected; thereby signalling when a predetermined number of packages have been emplaced in the receiver means in order that the second means can move the predetermined number of packages from beneath the gate means to make room for the next plurality of packages.

The second means, similarly as described with respect to the clearance means, will take a form that is appropriate to the type of receiver being employed. As illustrated, the second means comprises: (1) a carriage 141, FIG. 4, carrying, in addition to the active ram 85 and load chute 65, at least one additional ram and load chute and movable to sequentially place respective rams and load chutes under the gate means while another load chute is being employed to place the predetermined number of packages in a container; and (2) moving means 143, FIG. 5, for moving the carriage 141 as necessary. As illustrated, the moving means 143 serves as a shift means that moves the carriage 141 laterally along slide bars 145 within suitable inserts 147, FIG. 4, on the carriage 141. As illustrated in FIG. 4, the carriage 141 has mounting brackets 149 supporting the respective shafts 69 on which are mounted the structural framework, including integrally connected members 77 and anchoring end 151. The carriage 141 has a downwardly extending shaft 153, with its nut 155 and cotter key 157 for being fastened with linkage 161, FIG. 5. The linkage 161 is connected with the bell crank 163. The bell crank 163 is mounted for pivotal movement via shaft 165 and has its other end 167 connected with suitable motor means 169. Motor means 169 includes its shaft 171 and linkage 173 such that, once activated, the carriage 141 is moved completely to one side or to the other. As illustrated, the motor means 169 comprises a pneumatically operated piston and cylinder arrangement for fast operation.

Figure 6:
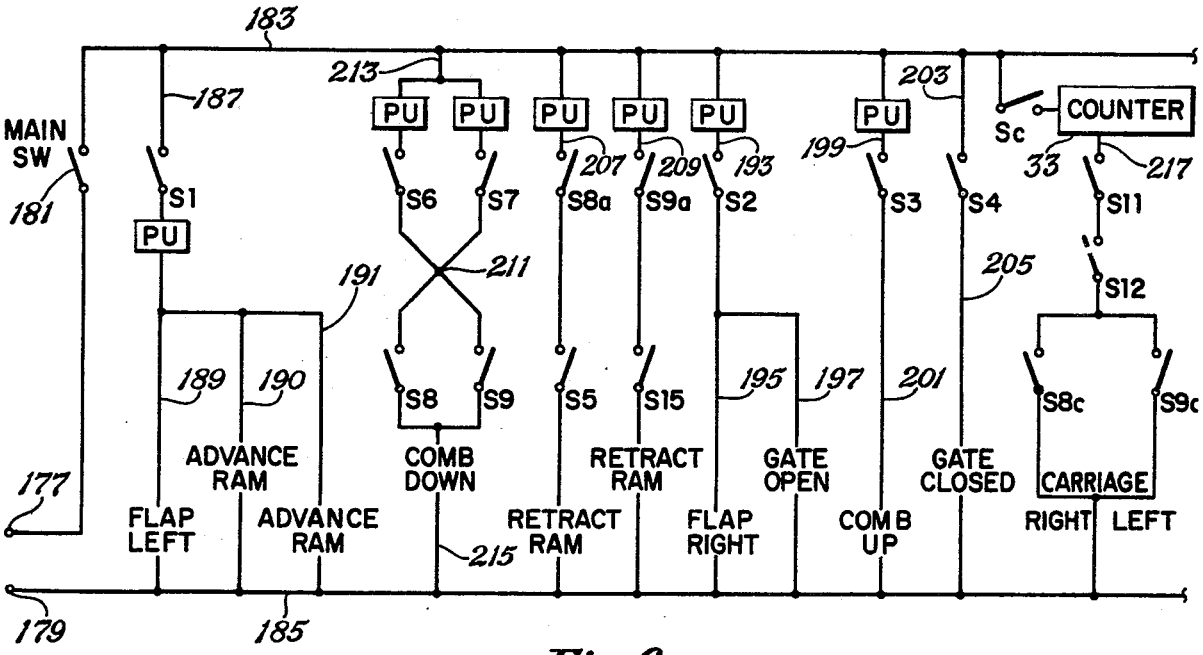
FIG. 6 is an electrical schematic showing the respective switches in the embodiment of FIGS. 1–5.
Figure 7:
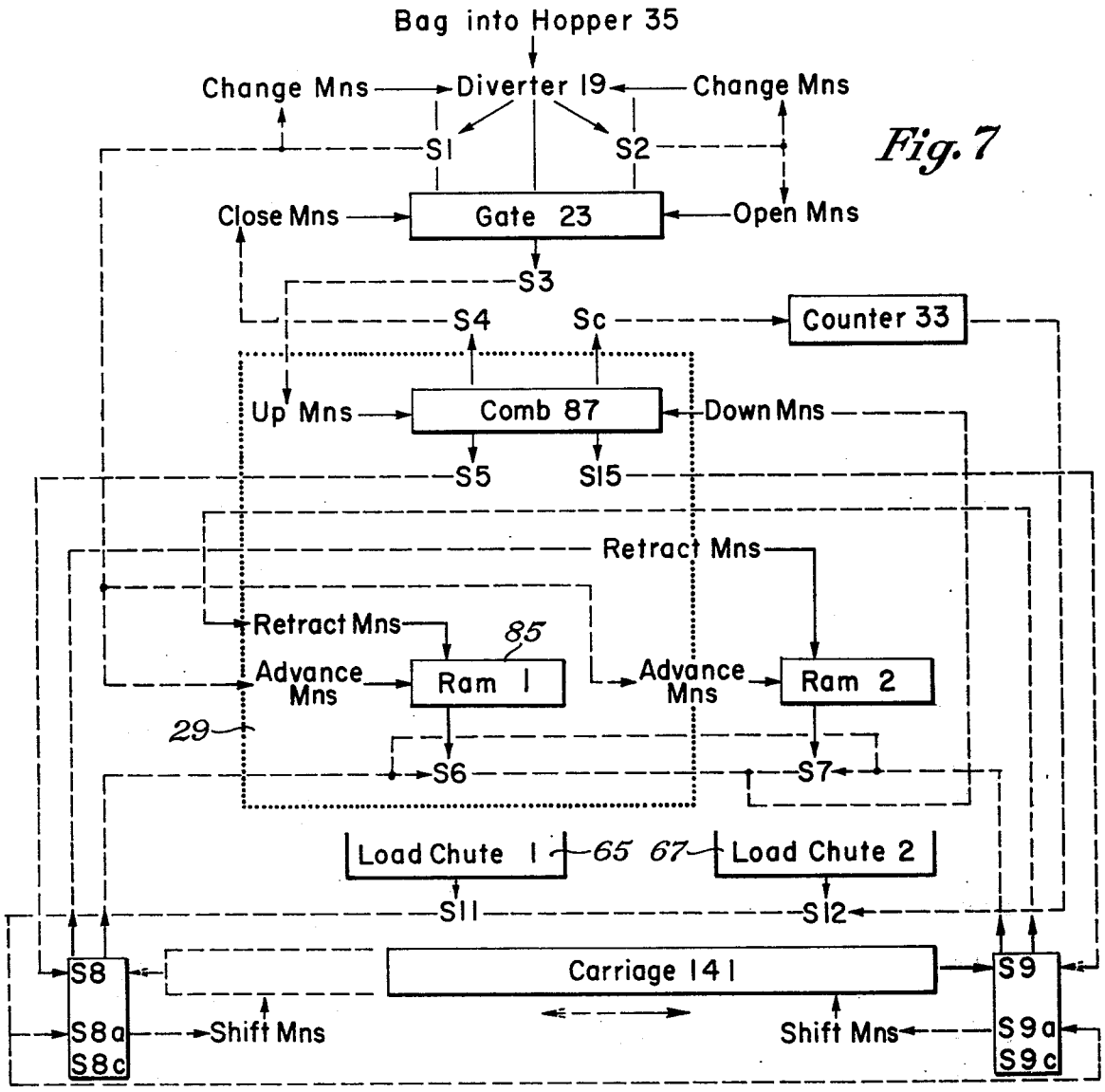
FIG. 7 is a schematic diagram illustrating the operation of the embodiment of FIGS. 1–6.

To effect proper sequential operation of the apparatus 11, a plurality of interrelated limit switches are employed. The electrical and functional schematics of the system are illustrated in FIGS. 6 and 7. In the embodiment of FIG. 6, the block labeled PU denotes a pulse unit which, as described hereinbefore, is activated by a closed circuit to sent its signal and effect an indicated action; and, thereafter, is deenergized until a different closed circuit is effected. These pulse units are conventional and are frequently employed to simplify circuits, particularly one having a large number of switches like the illustrated embodiment of this invention. Referring to FIG. 6, terminals 177 and 179 represent a source of power. A main switch 181 is serially connected with one of the terminals such as terminal 177 for 'turning on' the apparatus 11. Conductor 183 is connected with main switch 181. Conductor 185 is connected with the other terminal 179. After closure of main switch, a potential series circuit exists between conductor 183 and conductor 185. The switch S1, FIGS. 2 and 7, is disposed in chute 1 so as to be activated by bag number 1. Switch S1 is connected with the advance means so as to effect advance of the rams that are not already advanced upon closure of S1. The switch S2 is disposed in the second chute, as indicated hereinbefore, and is connected with the open means so as to effect opening of the gate 61 upon closure of S2. The switches S1 and S2 are also connected with the first change means so as to position the flap 43 serving as the diverter means 19 to direct the next bag 39 into the other chute. Referring again to FIG. 6, the switch S1 is serially connected with its pulse unit and conductor 183 by way of conductor 187; and its pulse unit is connected, by way of respective conductors 189–191, with the first change means so as to move the flap 43 to the left and with the advance means so as to advance the respective rams. The first change means and the respective advance means are also connected with the conductor 185 to complete their respective circuits. The switch S2 is connected via conductor 193 with its pulse unit and conductor 183; and with the first change means by way of conductor 195 so as to effect movement of the flap 43 to the right; the first change means also being connected with the conductor 185, as indicated. The switch S2 is also connected with the open means by way of conductor 197 so as to effect an opening of the gate 61, the open means also being connected with the conductor 185.

A switch S3, FIGS. 2, 6 and 7, is disposed so as to be closed by the opening of the gate 61. Switch S3 is connected with the up means so as to effect raising of the comb upon closure of the switch S3 by the opening of the gate. Specifically, the switch S3 is connected with conductor 183 via conductor 199 and its pulse unit. The switch S3 is connected with the conductor 185 by way of conductor 201 and the up means so as to effect raising of the comb 87. A switch S4 is disposed so as to be closed by the raising of the comb 87. The switch S4 is connected with the close means so as to effect closing of the gate 61 upon closure of the switch S4. The switch S4 is connected with the conductor 183 by way of conductor 203. The switch S4 is connected with the conductor 185 by way of conductor 205 and the close means so as to bring the gate 61 into the closed position.

A plurality of remaining switches operate in conjunction with safety switches that ensure proper alignment. For example, respective carriage shift monitoring switches S8, **S8*a* and S8*c*, and S9, S9*a* and S9*c*, illustrated generically by multi-contact switches S8 and S9 in FIG. 5, are disposed, respectively, on each side adjacent the ends of the rails 145 such that one set of switch contacts of either the S8 series or the S9 series are closed if the carriage has shifted into proper alignment. Expressed otherwise, the switches S8 and S9 located at either end of the rails 145** have a plurality of contacts for convenience in interconnecting the switches in series with other switches to effect results which will become apparent hereinafter.

Switches S5 and S15 are disposed so as to be closed by the movement of the comb 87 into the down position. The switches S5 and S15 are connected respectively by way of switches S8 and S9 with respective retract means for effecting retracting of the active ram whose carriage monitor switch is closed. As illustrated in FIG. 6, switch S5 is serially connected via conductor 207 with a set of contacts in switch S8 that are arbitrarily designated switch **S8*a*, its pulse unit, and conductor 183. The switch S5 is connected with conductor 185 via the retract means so as to effect retraction of the ram when S5 and S8*a* are closed. In like manner, conductor 183, pulse unit, conductor 209, switch S9*a*, switch S15, retract means and conductor 185 are serially connected so as to effect retraction of the other ram, such as ram 2 when S15 and S9*a*** are both closed.

Switches S6 and S7 are disposed so as to be closed by advancing of their respective rams. The switch S7 is illustrated on the bottom of the load chute 65 in FIG. 4 and S6 is illustrated in FIG. 3 to show that forward movement of the guide rod 101 will close the respective switch S6 or S7. The respective switches S6 and S7 may be positioned so as to be closed by any part of the advancing connection such as linkage 97, if desired. Switches S6 and S7 are connected with the down means and with the parallel connected switches S8 and S9 so as to effect lowering of the comb 87 upon closure of one of S8 and S9 and one of S6 and S7. As illustrated in FIG. 6, S6 and S7 are connected with their respective pulse units in one parallel-connected set of switches; S8 and S9 are similarly connected in parallel; and the two separate sets of switches are serially connected together at junction 211. The network thereby provided is serially connected with the conductor 183 by way of conductor 213; and connected with conductor 185 by way of conductor 215 and the down means so as to effect movement of the comb downwardly into the down position upon the closure of either switch S6 or S7 and either switch S8 or S9. Because of the respective pulse units, however, once switch S6 or S7 closes and remains closed, as by the inactive ram remaining forward, the down means only responds one time and is thereafter controlled by the other switch S7 or S6 being repeatedly or operated by the active ram.

Additional safety switches S11 and S12 are disposed so as to be closed by the normal position of the respective load chutes. As illustrated in FIG. 4, the switches S11 and S12 are disposed beneath the respective piston and cylinder arrangements 99, although they may advantageously be placed at any other appropriate location. Switches S11 and S12 are provided for preventing the shifting of the carriage 141 if either of the load chutes 65 or 67 are pivoted out of the normal "at rest" position, since the load chutes could encounter the comb 87, or other part of the apparatus and result in damage by the rapidly moving carriage 141 when it is shifted to the right or the left. A counting switch $S_c$ is disposed so as to be closed by raising of the comb. The switch $S_c$ is connected with the counter 33 so as to effect registration of a count upon closure of $S_c$. As indicated hereinbefore, the counter 33 counts the closures of $S_c$ and when a predetermined number has been effected, indicating that a predetermined number of packages have been transferred into the load chute, such as load chute 65, a signal is sent by way of safety switches S11 and S12 and one of the safety switches **S8*c* or S9*c* to effect shifting of the carriage to the right or to the left, opposite to the side on which it is already emplaced. As illustrated in FIG. 6, the counter 33 is serially connected with the conductor 183 via switch $S_c$ for registration of counts. The counter 33 is serially connected with switches S11 and S12 via conductor 217. The serially connected switches S11 and S12 are connected with conductor 185 by way of parallel connected switches S8*c* and S9*c* and the shift means for effecting shifting of the carriage 141 to either the right or the left in response to closure of both switches S11 and S12, a signal from the counter 33 and the closure of one of the switches S8***c* or S9*c*. The direction in which the carriage 141 will be shifted is determined by which of the switches S8*c* and S9*c* are closed, the direction being opposite to the switch that is closed. Expressed otherwise, if the right hand limit switch S9*c* is closed the shift of the carriage 141 is to the left; or, conversely, if the left hand switch S8*c* is closed the carriage 141 is shifted to the right. It is believed instructive to consider somewhat broadly the steps employed in the operation of the apparatus described hereinbefore. The following functional flow diagram will illustrate the broad steps and will help to understand the sequence of operation.

Insert (3)

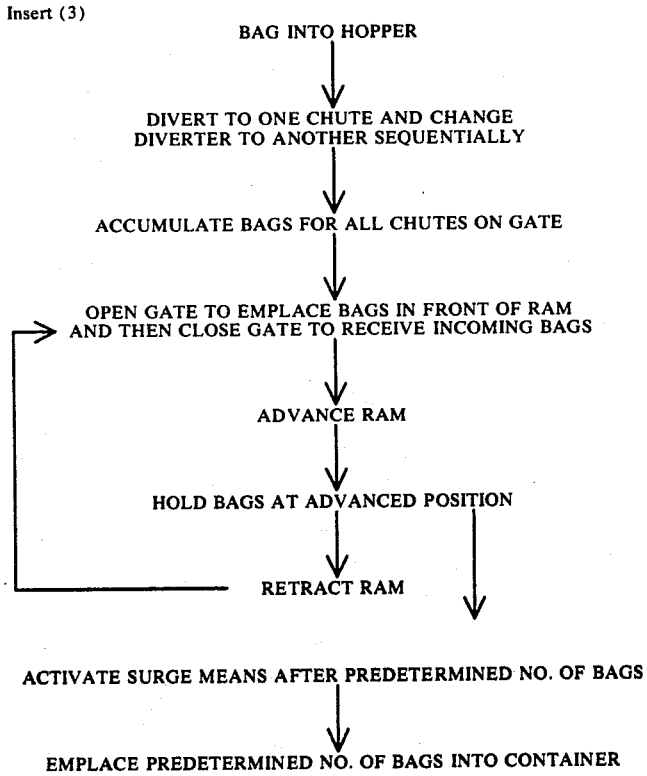

FUNCTIONAL FLOW DIAGRAM

Figure 8:
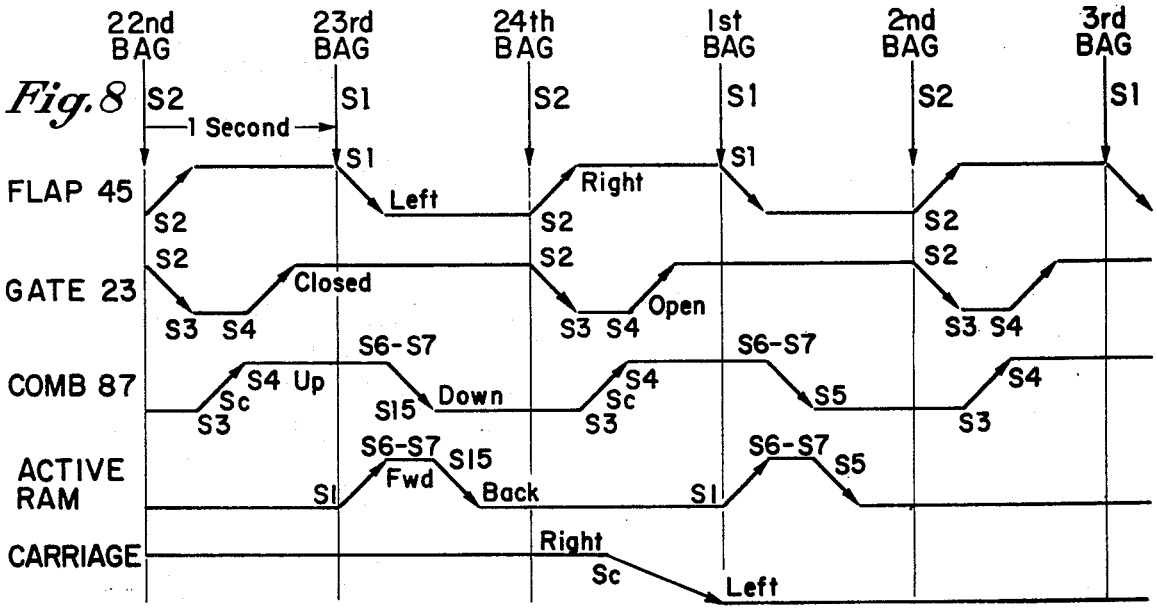
FIG. 8 is a flow diagram illustrating operation of the elements of the apparatus of FIGS. 1–6 and the transition from one predetermined number of packages to a second predetermined number of packages.

FIGS. 7 and 8 are, respectively, schematic and individual element flow diagrams that are helpful in understanding the operation of this invention. Assume that 24 bags are to be emplaced in a flexible walled container, or bale. Consideration of the sub-cycles for the last few bags of a cycle, and the first sub-cycles for a few bags of the next cycle will reveal completely the operation of apparatus 11. A bag 39 filled with product is being supplied each second to the semi-automatic packing apparatus 11. Assume the twenty-second bag is being fed to the apparatus 11. The bag 39 is fed into the hopper 35. The flap 43 serving as the diverter 19 diverts the bag 39 into the right hand chute 17. The falling bag 39 hits arm 57 and closes switch S2. Closing switch S2 activates the first change means 21 by energizing the motor means 51 to switch the flap 43 to the right so that it will divert the next bag into the left hand chute 15. The closure of switch S2 indicates that S1 will have been previously closed by the twenty-first bag being moved into the left hand chute, so the gate means 23 is full, having collected bags from both chutes 15 and 17. Thus, closing switch S2 activates the open means by energizing motor means 79 to open the gate means 23 and to allow both bags to fall into the load chute 65 emplaced therebeneath. Opening of the gate means 23 closes switch S3. Closure of switch S3 activates the up means to supply fluid pressure to the piston rod side of the piston in the piston and cylinder arrangement 125 and to effect movement of the comb 87 from its down position to its up position, FIG. 3. Upward movement of the comb 87 effects closure of switch $S_c$ to advance the counter one count. Movement of the comb 87 into the up position closes switch S4. Closure of switch S4 activates the close means by oppositely energizing motor means 79 to effect closure of the gate means 23 for receiving the next plurality of packages.

The next, or twenty-third, bag 39 is diverted to the left to effect closure of switch S1, which operates the first change means 21 to move the flap 43 to the left hand side so that the next succeeding bag 39 will be diverted to the right hand chute 17 again. Closure of switch S1 also activates the advance means to supply fluid pressure to the piston rod side of the piston in the piston and cylinder arrangement 99 causing ram 85 (number 1) to be moved to the forward position, simultaneously advancing the bags in the upright position in which they have been dropped into the load chute 65.

If ram number 2 has already been moved to the forward position as for tilting of the load chute 67 to dump its predetermined number of bags into the container 71, ram number 2 will not move forward. Closure of the switch S6 by the advancing of ram number 1, in conjunction with the closed contact in switch S9, activates the down means, to supply fluid pressure to the cylinder side of piston and cylinder arrangement 125 and move comb 87 into its down position to hold the bags and allow the ram 85 to be retracted. Movement of the comb 87 downwardly closes switches S5 and S15. Closing switch S15 completes electrical circuit to the retract means of ram number 1 via the closed contact S9*a*, activating the retract means by supplying fluid pressure to the cylinder side of the piston in the piston and cylinder arrangement 99, thereby retracting ram number 1 to receive the next plurality of bags.

The next incoming, or twenty-fourth, bag 39 is diverted to the right by the flap 43 being to the left, closing switch S2. As described hereinbefore, closure of switch S2 activates the change means to change the flap 43 back to the right so that it will divert the next bag into the left hand chute. Simultaneously, closing S2 effects opening of the gate means 23, as described hereinbefore in detail, closing switch S3. Closure of switch S3 effects moving of the comb 87 upwardly into its up position. Upward movement of the comb 87 closes $S_c$. Closure of switch $S_c$ advances the counter one count and, since the counter will have attained the predetermined and predesignated number 12 to indicate 24 bags, a signal will be sent via switches S11 and S12 and one of S8 or S9 to the shift means to effect shifting of the carriage 141. Shifting of the carriage 141 to the other side moves the other ram and load chute under the gate means 23 such that they become the active ram and chute. Consequently, the former active load chute and ram are moved into position in which the load chute 65 can be pivoted to dump its predetermined number of bags into the container 71. When comb 87 moves to its up position it closes switch S4. Closure of switch S4 effects closure of gate means 23.

As illustrated in FIG. 8, the first incoming bag of the next predetermined number effects closure of switch S1. Closure of switch S1 effects diverting of flap 43 to the other side; and advancing of ram 1 even though it has been moved laterally. Ordinarily, ram 2 will have been retained in its advanced position during the dumping of its predetermined number of bags into its container 71; so ram 2 will not be advanced. The container 71 is emplaced about load chute 1, which is thereafter pivoted to dump its 24 bags into the container 71, to bale the 24 bags for storage and shipment. Simultaneously with the baling, the packing sub-cycles and cycles continue, as described in detail hereinbefore and repeated in abbreviated language hereinafter. Advancing ram 1 closes switch S6, lowering comb 87 into load chute 2 now. Switch S5 is closed retracting ram 2, since switch S8*a* is closed. Switch S15 is also closed but ram 1 is not retracted, since switch S9*a* is open. Accordingly, load chute 2 is ready to receive the next two bags from gate means 23. The second bag effects closure of switch S2. Closure of S2 effects diverting of flap 43 to the other side and opening of gate means 23. Opening gate means 23 closes S3; raising comb 87. Switch $S_c$ is closed to register a count in counter 33. Switch S4 is closed to effect closure of gate means 23. The remaining sub-cycles are carried out with respect to ram 2 and load chute 2 until the cycle is completed, or until the predetermined number of bags are emplaced in the load chute, as determined by the counter 33. As the cycle is completed, the carriage 141 is shifted to the other side and the transition back to making ram 1 and load chute 1 active is carried out similarly as described hereinbefore but conversely, of course. The repeating of the the sub-cycles and cycles continues as long as the packing is to be continued. The automatic packaging machines and the semi-automatic packing apparatus 11 can be employed over a plurality of shifts merely by changing the operator. Because the carriage 141 can be removed, it acts as a surge means to allow the operator to leisurely pivot the load chute and dump its predetermined number of bags into the container 71 without overworking the operator.

Figure 9:
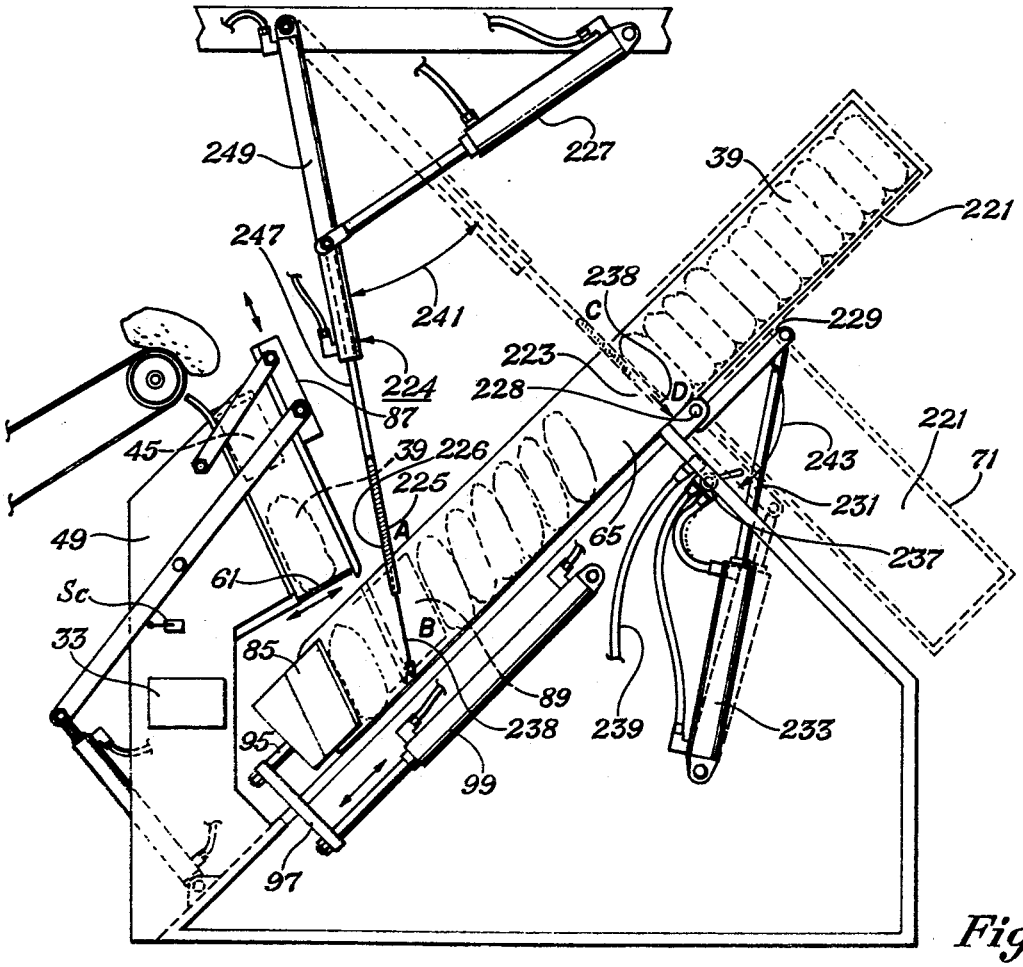
FIG. 9 is a side elevational view, partly schematic, of another embodiment of this invention employing a different type of surge means in the form of a pivotally mounted load chute disposed adjacent the open end of a first load chute.

Another Embodiment: Another embodiment of this invention is illustrated in FIG. 9 which is a side elevational view that is partly schematic for clarity of illustration. The main frame 49 with its flap 45, comb 87 and their associated first change means 21, and up and down means comprise essentially the same elements and operate essentially the same as described hereinbefore. Accordingly, the details are omitted from FIG. 9 to simplify illustration and understanding. The gate means 23 is illustrated, however, as a reciprocally movable gate 61, employing suitable motor means in the form of either a pneumatically powered ram or a Bellows air motor and linkage, both described hereinbefore, to effect movement of the gate 61 rearwardly from beneath the bottom of bags 39 to allow the bags to fall, or be emplaced by gravity, in front of the active ram 85. The opening and closing of the gate 61 is functionally the same as previously described. The active ram 85 is advanced and retracted by the piston and cylinder arrangement 99, the linkage 97, and the rod member 95, similarly as described hereinbefore. In the embodiment of FIG. 9, however, only one active ram and active load chute 65 are employed and are not moved laterally. Expressed otherwise, they are not mounted on a carriage for lateral movement to form a surge means. Instead, the surge means comprises a surge chute 221 that is linearly aligned with the load chute 65 and disposed adjacent its open end 223 so as to receive the plurality of packages moved longitudinally of the load chute 65 and out of the open end. The surge chute 221 is mounted on shaft 228 by a member 229 for pivotal movement of its free end downwardly for unloading a predetermined number of bags into a container 71.

To serve as a second means for moving the predetermined number of bags out of the load chute 65 and afford surge room, a second comb 224 is provided. The second comb 224 has a free end 225 that is movable into a pre-load position behind the predetermined number of packages and movable longitudinally of the load chute to a load position to move the packages out of the open end 223 of the load chute and into the pivotally mounted surge chute 221. A pneumatically operated ram 227 serves as a second moving means for moving the free end 225 of the second comb 224 longitudinally of the load chute 65. The free end 225 includes a plurality of tubular teeth 226, each having a biased extensible portion 238. The teeth 226 are retractable, either individually or by retracting the entire free end by way of piston rod 247 into cylinder 249.

The pivotally mounted surge chute 221 has its open end unobstructed such that an open ended container can be emplaced about the open end thereof and the pivotally mounted surge chute pivoted to emplace the predetermined number of bags into the container 71. To alleviate strain by an operator and to facilitate pivoting of the pivotally mounted surge chute 221, its member 229 is connected with the piston rod 231 of a pneumatically powered ram 233. The pneumaticaly powered ram 233 is employed merely as an adjustable biasing means to bias the chute 221 toward its normal position. As illustrated, the ram is connected with a toggle valve 237, that is connected via conduit 239 with a source of fluid under pressure; such as, air when it is pneumatically operated. Thus, the operator may simply flick the toggle valve down and the pivotally mounted chute 221 will be moved into the dump position for unloading the predetermined number of bags 39 into container 71 emplaced about the surge chute 221. After the load of the predetermined number of bags 39 has been emplaced in the container 71, the operator flips the toggle valve 237 to again place the pivotally mounted surge chute 221 in the normal position, as illustrated. The dump position is illustrated by dashed lines. If desired, the hydraulic ram 233 may be connected with a regulator such that a predetermined biasing force may be employed to bias the pivotally mounted surge chute 221 toward its upper, or normal, position and the force of the biasing adjusted by adjusting the regulator to control the pressure fed to the pneumatic ram.

In operation of the embodiment of FIG. 9, the bags are fed into the diverter, diverted into their respective chutes, collected on the gate and dumped from the gate in front of the active ram 85 sequentially as described hereinbefore with respect to the embodiment of FIGS. 1–8. Similarly, the active ram 85 advances the bags and the comb 87 is lowered to retain the bags in their advanced position while the ram 85 is retracted to receive the next plurality of bags from the gate 61, similarly as described hereinbefore. The difference occurs when the predetermined number of bags have been emplaced in the load chute 65. In contrast to shifting laterally, as described hereinbefore, the second comb 224 has the teeth of its free end 225 retracted and moved over the plurality of bags in the load chute 65 and then extended to engage the slots 89 within the ram 85. The second comb 224 is then moved forwardly, indicated by the arrow 241, by retraction of the piston rod into the ram 227. As the free end 225 is moved longitudinally of the chute 65, the biased extensible portions 238 will be compressed upwardly into the tubular teeth 226 comprising the free end 225 and the bags will be slid longitudinally of the chute 65 into the surge chute 221, illustrated by movement of the second comb from the pre-load position AB to the load position CD. Thereafter, the operator places the container about the surge chute 221 and flips the toggle valve 237 to pivot the surge chute 221 downwardly, indicated by arrow 243. This dumps the predetermined number of packages into the container 71. The filled container may be set aside for sealing, storage and shipment. The operator flips the toggle valve 237 to return the surge chute to its uppermost position.

Each of the sub-cycles, with respect to each bag and pair of bags, in a cycle is repeated, similarly as described in detail with respect to the FIGS. 1–8 hereinbefore. Upon occurrence of the predetermined number of counts in the counter, the second comb 224 has its free end 225 retracted, passed to the pre-load position and extended by rams 249 and 227 to again advance the second predetermined number of packages into the surge chute 221. As the second comb 224 has its free end 224 retracted, the extensible portions 238 may be independently retracted and then extended by the extension of the free end 225. On the other hand, the free end 225 may be retracted far enough that spring biasing can be employed for biasing the extensible portions 238 outwardly until the encounter the bottom of the chute. In any event, the second comb 224 has the teeth 226 of its free end 225 emplaced into the deep slots 89 in the ram 85 and moves the predetermined plurality of bags out of the load chute 65, without interfering with the normal operation of the comb 87.

ANOTHER EMBODIMENT FOR OPEN TOP CONTAINERS

Figure 10:
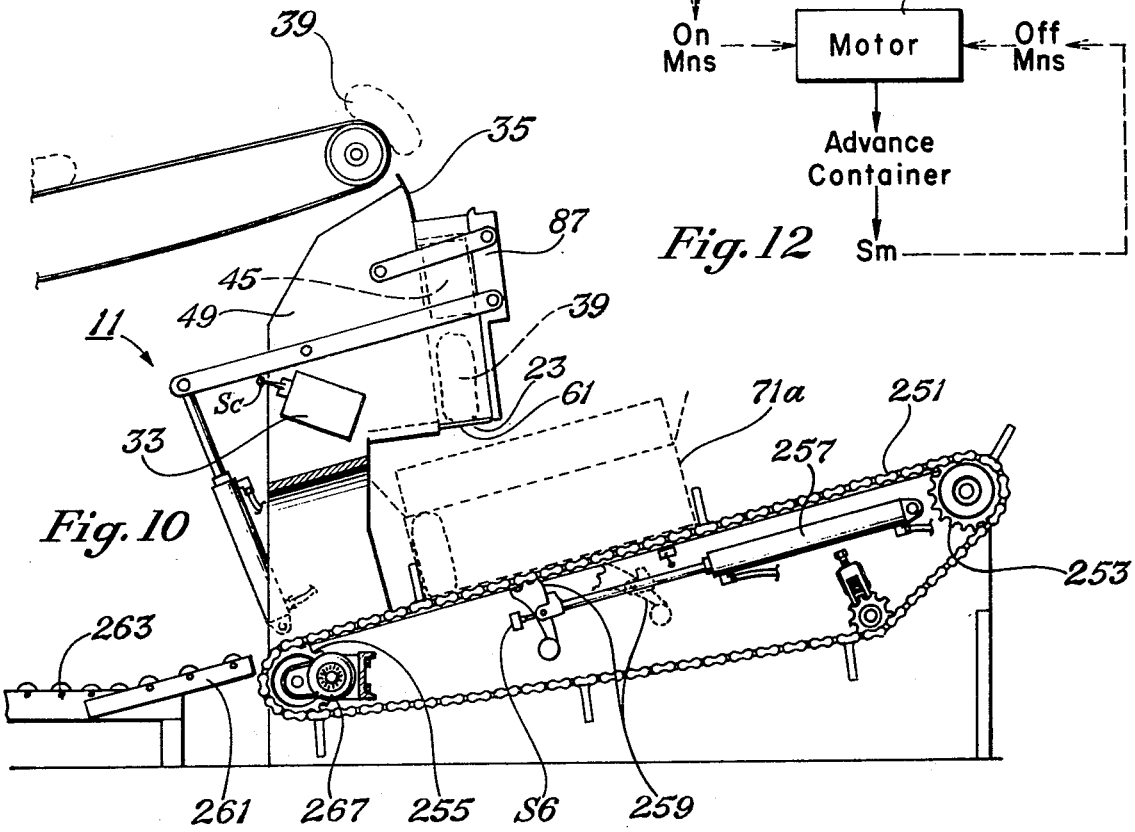
FIG. 10 is a side elevational view, partly cut away and partly schematic, of still another embodiment of this invention for packing open top containers.

FIg. 10 illustrates still another embodiment of this invention that may be employed for packing open top containers with the packages coming from automatic packaging apparatus. As with FIG. 9, FIG. 10 is partly schematic for clarity of illustration. The apparatus 11 has main frame 49 with flap 45, gate means 23, comb 87 and their associated first change means 21, open and close means, and up and down means that comprise essentially the same elements and operate essentially the same as described hereinbefore. Accordingly, the details are omitted from FIG. 10 to simplify illustration and understanding. In the embodiment of FIG. 10, however, the opening and closing of the gate 61 allows the bags 39 to drop into an open top container 71*a*. The open top container 71*a* is carried on top of an endless chain track 251. The chain track 251 is supported in suitable guides (not shown) and is carried over idler sprockets 253 and 255. A ram 257 is provided for advancing the chain track 251; and, consequently, the container 71*a* when the advance signal is supplied by closure of switch S1, as described hereinbefore. The ram 257 has a ratchet engaging means 259 that engages the chain track 251 on the forward stroke of the ram 257 for advancing; but ratchets, as illustrated in ghost lines, when the ram 257 is retracted to be ready for the next advancement. The retraction of the ram is effected upon closure of switches S5 and S15 if the comb 87 is employed, as for keeping the bags upright in container 71*a*.

Disposed adjacent chain track 251 are inclined conveyor 261 and conveyor 263 for receiving the containers 71*a*. If desired, the conveyor 263 may provide a path of travel for returning the container 71*a*, after it has been filled with the predetermined number of bags, around the machine and to the operator. Such a return allows the operator to remain in one spot and facilitates placing empty containers 71*a* on the chain conveyor 251 and removing filled containers 71*a*.

The advantage of the embodiment of FIG. 10 is that it allows the same configuration of the main frame 49, with the accoutrements described hereinbefore, to be employed either with open top containers or with open end containers.

The operation is essentially the same as described hereinbefore. An incoming bag 39 is fed into the hoppers 35 and into one of the chutes, activating one of the switches S1 or S2 (not shown in FIG. 10). The bags are accumulated on top of the gate means 23 and then dropped into the container 71*a* by opening of the gate means 23. The bags 39 may be retained in their upright position in container 71*a* without use of the teeth of comb 87 if the container 71*a* is properly positioned; for example, canted at a proper angle as described hereinbefore with respect to load chute 65. Opening of the gate means 23 closes switch S3, effecting raising of comb 87. The container 71*a* is then advanced an increment to make room for the next plurality of bags being deposited adjacent the preceding plurality. The comb 87 is lowered and raised primarily to maintain the sequence of operations. The comb 87 is lowered by closure of switch S6, effected by advancing ram 257 to advance container 71*a*. Lowering of comb 87 closes switch S5, effecting retraction of ram 257. After a predetermined number of bags have been deposited in the container, as indicated by the counter 33, the container 71*a* is advanced by a second means. The second means may comprise a motor 267 drivingly connected with sprocket 255 for advancing the container 71*a* a double amount after the predetermined number of bags have been emplaced therein. Advancing the sprocket 255 also advances chain track 251 and emplaces the new container 71*a* beneath the gate means 23. The first container 71*a* will have been moved such that it is no longer carried by the chain track 251, but comes to rest upon the conveyors as the new container 71*a* is emplaced beneath the gate means 23.

Figure 11:
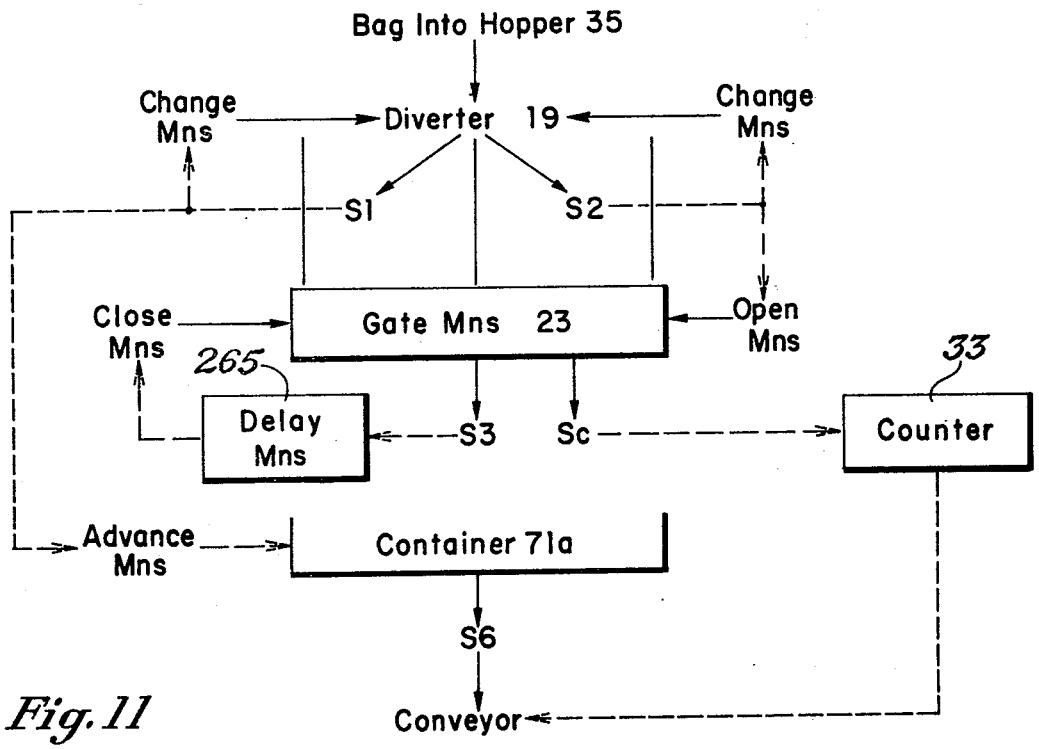
FIG. 11 is a schematic diagram of a simplified embodiment for packing open top containers.

If open top containers only are to be employed, the apparatus 11 illustrated in FIG. 10 can be simplified. For example, the comb 87 is no longer necessary if the open top containers 71*a* are properly canted on chain track 251; and can be omitted. When the comb 87 is omitted, the switching is rearranged and simplified. The schematic diagram of FIG. 11 illustrates a simplified switching arrangement that can be employed. In operation of the embodiment of FIG. 11, the bag comes into the hopper 35 and is diverted into its respective chutes by the diverter 19 as described hereinbefore. Closure of the respective switches S1 and S2 effects operation of the respective first change means to switch the diverter 19 as described hereinbefore. Closure of switch S2 also effects opening of the gate means 23 to allow the bags 39 to fall into the container 71*a*. In the embodiment of FIG. 11, the switch S3 that is closed by the opening of the gate means 23 is connected with a delay means, such as the delay means 265. The delay means 265 is connected with the close means for effecting closure of the gate means 23 after a predetermined delay; for example, a desired number of milliseconds. Closure of the switch S1 effects advancing of the advance means such as advancing of the ram 257, concomitantly effecting advancement of the container 71*a* on the chain track 251 as described with respect to the embodiment of FIG. 10 hereinbefore. Closure of switch S6, FIG. 10, by the advancing of the ram 257, to advance container 71*a*, activates the retract means to effect retraction of the ram 257 and its ratchet engaging means 259 to be ready for the next advancing of the container. After a predetermined number of bags 39 have been emplaced in container 71*a*, it is moved out and a new container 71*a* emplaced beneath the gate means 23 by the second means, as described with respect to FIG. 10. The filled container 71*a* may be fed onto the conveyors 261 and 263 by gravity. Alternatively, the conveyors 261 and 263 may be powered and be energized by a signal from the counter 33, as illustrated in FIG. 11. In the embodiment of FIG. 11, the switch $S_c$ is placed such that it is closed by the opening of the gate means 23, instead of the raising of the comb 87 as described with respect to the embodiment of FIGS. 1–9 hereinbefore.

Figure 12:
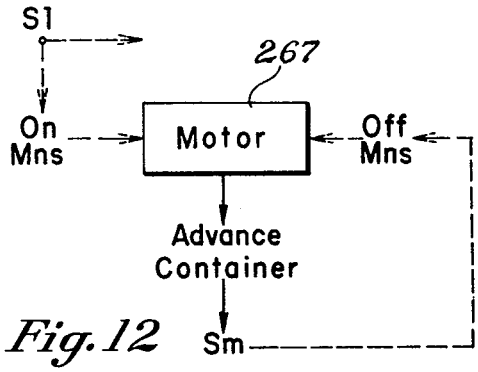
FIG. 12 is a partial schematic diagram of another embodiment for operating the chain track of the embodiment of FIG. 10.

The embodiments of FIGS. 10 and 11 have been described hereinbefore with respect to employing the advance means and the retract means such as previously described. If desired, the sprockets 253 and 255 may be powered by a motor, such as the motor 267 employed in the second means. A partial schematic showing operation of such a motor for advancing the chain track 251 and container 71*a* is illustrated in FIG. 12. Therein, the switch S1 is connected with the on means to turn on the motor and advance the chain track 251 to advance the container 71*a*. Advancing of the chain track 251 effects closure of a limit switch $S_m$ when the predetermined clearance has been effected in container 71*a* in preparation for receiving the next plurality of packages from the gate means 23. Closure of the switch $S_m$ turns the motor off by activation of the off means. With this embodiment, by proper placement of cams activating switch $S_m$ (e.g. allowing double advancement between containers), and by proper selection of the inclination of the conveyors, it becomes possible to dispense with the counter 33, since the respective advancements of the container will automatically discharge the container 71*a* from the conveyor track 251 and onto the conveyors for subsequent action. On the other hand, the counter 33 may be employed to effect a double advancement between containers, if desired. In the simplified embodiments of the invention described in FIGS. 11 and 12, it is preferred that the container 71*a* be inclined at an angle such that the bags which are fed thereinto by gravity will remain in the upright position, as described hereinbefore with respect to load chute 65.

General: As indicated hereinbefore, certain bales, or containers, hold larger bags in an "in line" arrangement of one behind the other; and, consequently, do not require the plurality of chutes and the diverter means. It is desirable therefore that the divider separating the pair of chutes 15 and 17 and the flap 43, serving as the diverter means 19, be removable and the switches be partially re-routed to function as shown on the abbreviated single chute flow diagram hereinafter. Either or both S1 and S2 are responsive to passing of a single large bag, as by having elongated interiorly extending arms 57 and 59. For single chute operation, the switches S1 and S2 are serially connected through a limit switch $S_o$ that is closed by retraction of ram 85, such that the gate means 23 is not opened until a bag has accumulated thereon and the ram 85 has been retracted. Moreover, the advance means is switched from switch S1 to switch Sc if a counter is employed or to S4 if not, to delay advancing the ram until after the comb is started upwardly. For simplicity and brevity the abbreviated single chute flow diagram does not show all of the other safety switches that may be employed, the surge means, and dumping of the bags into the container as described in the respective embodiments hereinbefore.

-continued

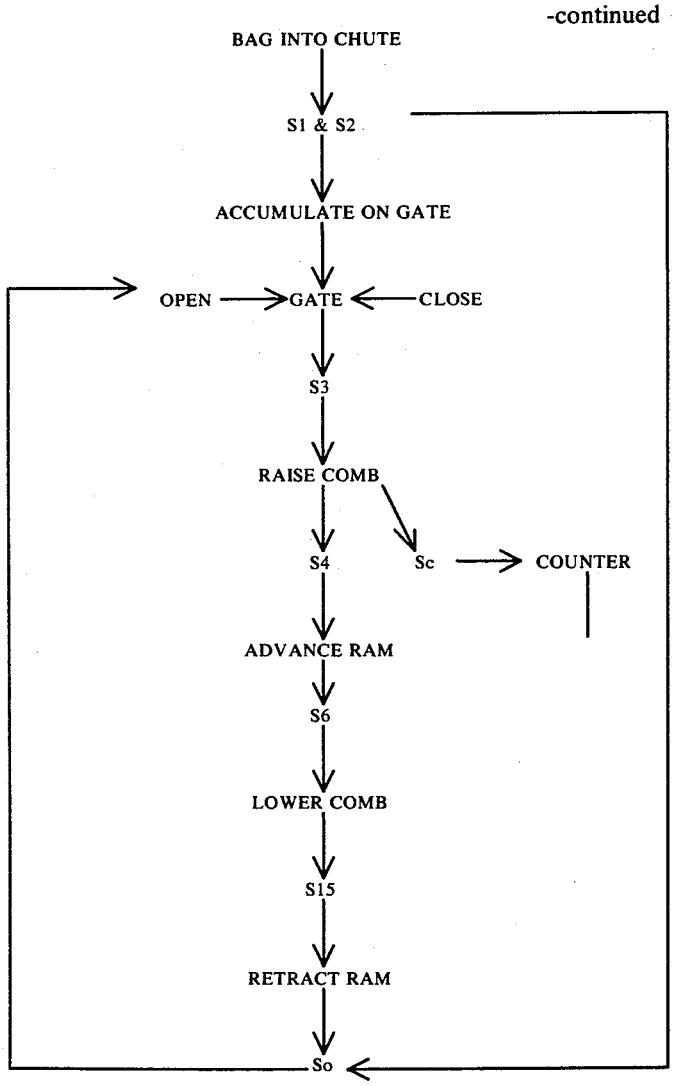

SINGLE CHUTE FLOW DIAGRAM

On the other hand, individual machines may be sold having, respectively, the single chute operation and the plural chute operation, if desired.

While specific arrangement of the switch means for monitoring respective chutes have been described hereinbefore, other arrangements may be employed if desired. For example, a source of light and a light sensitive switch means, commonly referred to as the "electric eye" system, may be employed to monitor the respective chutes for passage of packages therethrough.

As indicated hereinbefore, the gate means 23 may be pivotally mounted or moved reciprocally to move from beneath the packages and allow them to fall into the receiver means. Any other form of such gate means could be employed as long as it was operable and appropriate for the type of packages being used.

In the embodiments of FIGS. 1–9, the plurality of bags have been moved longitudinally of the chute by pushing against the frictional force on the bottom. If desired, an inner liner mounted on rollers may be employed to facilitate movement.

Once the principles of the invention embodied in the respective embodiments and the general approach have been delineated, a variety of other specific embodiments will come to mind to one skilled in this art. These embodiments are to be deemed within the scope of this invention if they employ the principles delineated hereinbefore.

From the foregoing, it can be seen that this invention provides semi-automatic packing apparatus that effects one or more of the objects delineated hereinbefore and alleviates the disadvantages of the prior art apparatus. In specific embodiments, this invention provides semi-automatic packing apparatus which has one or all of the desirable features delineated hereinbefore and not provided heretobefore.

Although this invention has been described with a certain degree of particularity, it is understood that the present disclosure has been made only by way of example and that numerous changes in the details of construction and the combination and arrangement of parts may be resorted to without departing from the spirit and the scope of this invention.

I claim:

1. A method of semi-automatically packing packages being supplied by automatic packaging apparatus at a rapid rate, comprising the steps of:

a. diverting said packages into at least one upstanding chute;

b. accumulating respective said packages from said at least one chute on a gate;

c. transferring said packages from said gate into an inclined load chute in fromt of an active ram in a desired position; said load chute being inclined at an angle sufficient for said packages to retain said desired position as they are advanced along said chute by said active ram;

d. providing clearance in said load chute for a next plurality of packages transferred from said gate by advancing said active ram and said packages deposited in front thereof; holding said packages; and retracting said active ram to receive an additional plurality of packages from said gate;

e. repeating steps a-d until a pre-determined number of packages have been accumulated in said load chute; and, thereafter, f. activating a surge means to move said predetermined number of packages from directly in front of an active ram; and emplacing said pre-determined number of packages into a container.

2. The method of claim 1 wherein the step of activating said surge means comprise sliding said predetermined number of packages longitudinally of said chute and onto a pivotally mounted surge chute; and wherein the emplacing of said predetermined number of bags into said container in accordance with step d is effected by emplacing an open end of said container about the open and exterior end of said surge chute and said surge chute is tilted to emplace said predetermined number of bags into said container.

* * * * *